US007287679B2

(12) United States Patent
Gaudron

(10) Patent No.: US 7,287,679 B2
(45) Date of Patent: Oct. 30, 2007

(54) POWDER ACTIVATED SETTING TOOL PISTON RETAINER ARRANGEMENT AND METHOD

(75) Inventor: Paul Gaudron, Stamford, CT (US)

(73) Assignee: Powers Products III, LLC, New Rochelle, NY (US)

( * ) Notice: Subject to any disclaimer, the term of this patent is extended or adjusted under 35 U.S.C. 154(b) by 130 days.

(21) Appl. No.: 10/900,492

(22) Filed: Jul. 28, 2004

(65) Prior Publication Data

US 2006/0022012 A1 Feb. 2, 2006

(51) Int. Cl.
*B25C 1/14* (2006.01)

(52) U.S. Cl. ..... 227/10; 227/9; 173/210; 173/211

(58) Field of Classification Search ..... 227/9, 227/10; 173/210, 211, 55
See application file for complete search history.

(56) References Cited

U.S. PATENT DOCUMENTS

| | | | | | |
|---|---|---|---|---|---|
| 2,898,893 | A | | 8/1959 | Rohrer et al. | 123/7 |
| 3,659,768 | A | * | 5/1972 | Brunelle | 227/10 |
| 4,114,792 | A | * | 9/1978 | Pomeroy | 227/8 |
| 4,162,033 | A | * | 7/1979 | Pomeroy | 227/10 |
| 4,655,380 | A | * | 4/1987 | Haytayan | 227/9 |
| 4,711,385 | A | | 12/1987 | Jochum | 227/10 |
| 5,273,198 | A | * | 12/1993 | Popovich et al. | 227/10 |
| 5,518,161 | A | * | 5/1996 | Thompson | 227/8 |
| 5,797,534 | A | * | 8/1998 | Almeras et al. | 227/10 |
| 6,085,958 | A | * | 7/2000 | Kersten | 227/10 |
| 6,092,710 | A | * | 7/2000 | Kersten | 227/10 |
| 6,123,242 | A | * | 9/2000 | Kersten | 227/10 |
| 6,481,609 | B2 | * | 11/2002 | Dittrich et al. | 227/10 |
| 6,536,647 | B2 | * | 3/2003 | Buchel et al. | 227/10 |
| 6,905,055 | B2 | * | 6/2005 | Maier et al. | 227/10 |
| 6,978,919 | B2 | * | 12/2005 | Bonig et al. | 227/10 |
| 7,028,876 | B2 | * | 4/2006 | Hirtl et al. | 227/8 |
| 2002/0104867 | A1 | * | 8/2002 | Wohlwend et al. | 227/9 |
| 2002/0130155 | A1 | | 9/2002 | Bonig et al. | 227/10 |
| 2004/0134959 | A1 | * | 7/2004 | Maier et al. | 227/10 |
| 2004/0149801 | A1 | * | 8/2004 | Hirtl et al. | 227/10 |
| 2004/0245308 | A1 | * | 12/2004 | Arnold et al. | 227/10 |

FOREIGN PATENT DOCUMENTS

| | | |
|---|---|---|
| DE | 2026293 | 5/1970 |
| DE | 490939 | 7/1970 |
| EP | 599157 A1 | 11/1993 |

* cited by examiner

*Primary Examiner*—Brian D. Nash
(74) *Attorney, Agent, or Firm*—Cantor Colburn LLP

(57) ABSTRACT

Disclosed herein is a powder actuated setting tool piston retainer arrangement which includes a housing and firing mechanism and a piston having a piston retaining ring in operable communication with the housing and firing mechanism. Further the arrangement includes a barrel within which the piston is slidably disposable. A cantilevered retainer is disposed at the barrel, the retainer being pivotally articulated with the barrel such that the retaining ring is contactable thereby to retain the piston in a selected position.

Further disclosed herein is a method for retaining a piston of a powder actuated setting tool in position. The method includes urging a cantilevered retainer radially inwardly of a barrel of the setting tool for the purpose of contacting a retaining ring of the piston of the setting tool. Such contact frictionally retains the piston in a selected position.

11 Claims, 2 Drawing Sheets

POWDER ACTIVATED SETTING TOOL PISTON RETAINER ARRANGEMENT AND METHOD

BACKGROUND

Powder actuated setting tools all utilize among other things, a powder charge to set in motion a piston which travels within a barrel. The barrel in one way or another houses a fastener to be forcefully ejected from the setting tool by the piston moving within the barrel. The piston is accelerated by expanding gas in a chamber, that expanding gas being occasioned by the burning of the powder charge. In order for the setting tool to function as intended, the piston must be maintained in a position appropriate to being driven by the expanding gas in the chamber of the setting tool. Effectively, the foregoing means that the piston needs to be held "up" when the setting tool is compressed to a firing position. As is familiar to one of ordinary skill in this art, setting tools of this type generally require compression of the setting tool against work surface before the tool will ignite the powder charge.

The cycle that is relevant to the current disclosure begins after firing the setting tool, the piston being in a "forward" position relative to the setting tool. Upon release of the compressive force applied to the setting tool by an operator thereof, a spring urges the setting tool away from the work surface. As this occurs, the piston is drawn back to a firing position, rearward of the setting tool. The piston must be maintained in this rearward position during the ignition of powder in order to develop the desired linear force due to gas expansion.

The problem arises when the setting tool is again compressed toward a work surface to dispense another fastener. Upon compression, in many of these tools, the components of the tool that hold the piston rearward of the tool are moved and do not support the piston in the desired rearward position. In such condition, the piston moves forward under gravity and linear force generated by expanding gas of burning powder is reduced. This is of course an undesirable result.

To remedy the forgoing problem, manufacturers have utilized different friction creating devices to hold the piston rearward. To date however, such devices have either been overly complex or have not worked reliably. Therefore the art is still in need of a simple yet effective and reliable configuration capable of maintaining the piston rearward of the setting tool until it is forcefully propelled forwardly of the setting tool pursuant to the ignition of the powder charge.

SUMMARY

Disclosed herein is a powder actuated setting tool piston retainer arrangement which includes a housing and firing mechanism and a piston having a piston retaining ring in operable communication with the housing and firing mechanism. Further the arrangement includes a barrel within which the piston is slidably disposable. A cantilevered retainer is disposed at the barrel, the retainer being pivotally articulated with the barrel such that the retaining ring is contactable thereby to retain the piston in a selected position.

Further disclosed herein is a method for retaining a piston of a powder actuated setting tool in position. The method includes urging a cantilevered retainer radially inwardly of a barrel of the setting tool for the purpose of contacting a retaining ring of the piston of the setting tool. Such contact frictionally retains the piston in a selected position.

BRIEF DESCRIPTION OF DRAWING

Referring now to the drawings wherein like elements are numbered alike in the several Figures.

DETAILED DESCRIPTION

Figure 1:
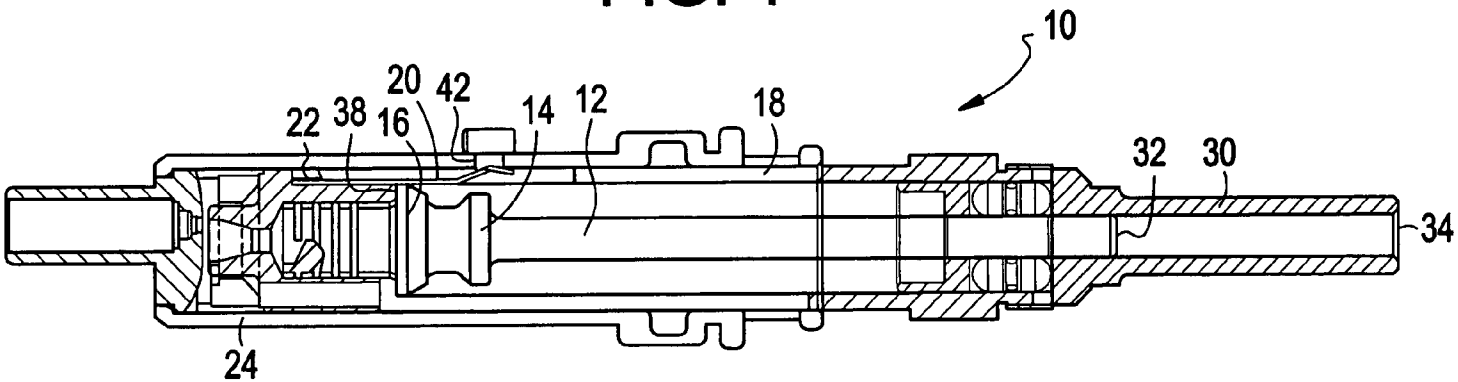
FIG. 1 is a cross section view of a setting tool piston barrel and barrel guide among other components thereof in a ready to discharge position.
Figure 4:
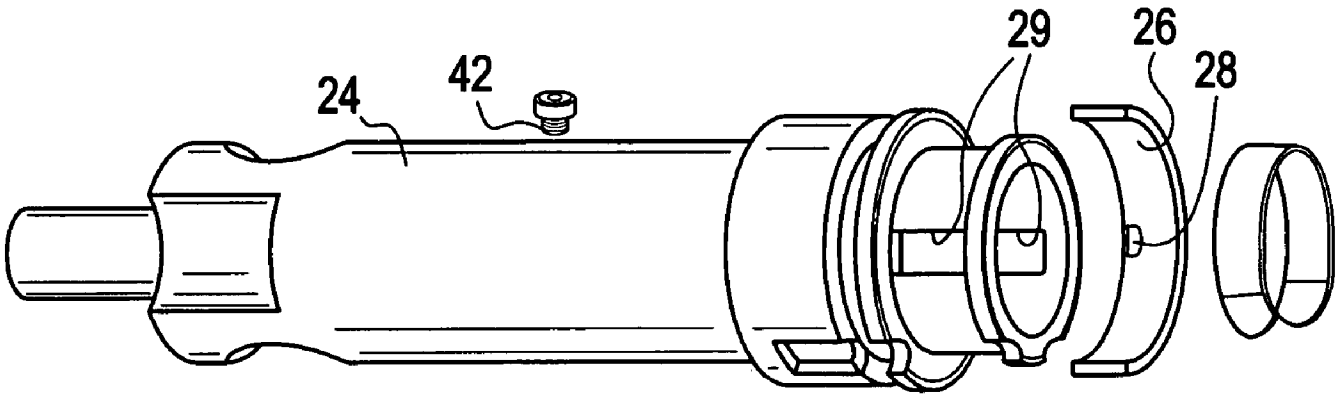
FIG. 4 is a perspective view of the barrel guide and related components alone.

Referring to FIG. 1, a barrel assembly of a powder actuated setting tool is generally referred to as 10. The barrel assembly is configured to be in operable communication with a setting tool housing and firing mechanism as is known to one of ordinary skill in the art. Because the focus of this disclosure is on the barrel assembly, and because of the degree to which one of skill in the art is aware of the common housing and firing mechanism, it is not necessary to illustrate in detail the components of such housing and firing mechanism. Therefore merely a perspective view of a setting tool is illustrated. The barrel assembly 10 includes a piston 12 with a head 14 and a retention ring 16. The piston 12 is housed within a barrel 18 having a cantilevered piston retainer 20 and a piston retainer spring 22. The barrel 18 is further housed within a barrel guide 24, (see FIG. 4) which barrel guide includes piston retaining ring supports 26 (only one of two shown). Supports 26 include a radially inwardly projecting support knob 28 sized sufficiently to extend through respective openings 29 in barrel guide 24 and into supportive contact with retaining ring 16.

Figure 2:
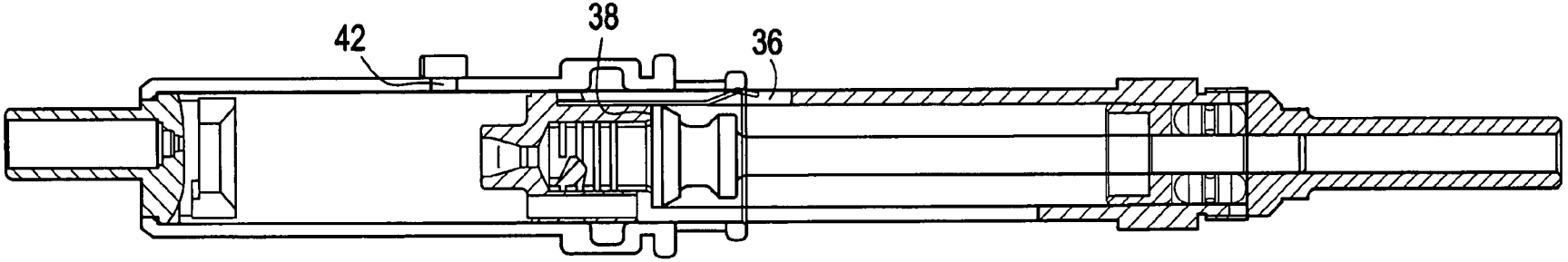
FIG. 2 is a cross-sectional view of the same piston barrel and barrel guide in a non-ready to discharge position.

As can be seen in FIG. 1 and 2, the piston 12 extends into a fastening element guide 30 and terminates therein at an impact end 32 of piston 12. Upon ignition of a powder charge in the setting tool, while the barrel assembly is in the FIG. 1 position, piston 12 moves (rightwardly in the drawing) end 32 toward an opening 34 in fastening element guide 30 thereby expelling a fastener (not shown) that would be within the open inside dimension of fastening element guide 30. Once piston 12 has moved into this position and thereby the fastener has been discharged to a workplace, the compressive force applied to the setting tool by the user is released and the barrel guide 24 and barrel 18 are urged to an extended position as illustrated in FIG. 2 by a coil spring (not shown). At the same time as the barrel 18 and barrel guide 24 are extended to a telescoped position, piston 12 is drawn in a direction opposite to the discharge direction with the barrel guide 24 by knobs 28 coming in contact with retaining ring 16.

As has been described above and as will be appreciated by one of ordinary skill in the art, when the setting tool is cycled from the condition illustrated in FIG. 2 to the condition in FIG. 1, piston 12 becomes unsupported by knobs 28 and therefore is able to fall (with gravity when the setting tool is flung downwardly) toward opening 34 thereby rendering it useless with respect to driving a fastener. In order to avoid the piston falling toward opening 34, cantilevered piston retainer 20 has been added to barrel 18 such that it is partially pivotally mounted under retainer spring 22 and against barrel 18 in a position aligned with a slot 36 and barrel 18 so that the piston retainer 20 may be urged radially inwardly into contact with retaining ring 16 to retain piston 12 in the desired position when the barrel assembly is in the position of FIG. 1. Viewing both FIGS. 1 and 2, the contact point between retaining ring 16 and retainer 20 is at 38. As can be seen in FIG. 1, the retaining portion 16, such as a ring as illustrated, is radially upstanding and contact point 38 is on a radially outermost surface of the retaining portion 16 and piston 12.

Figure 3:
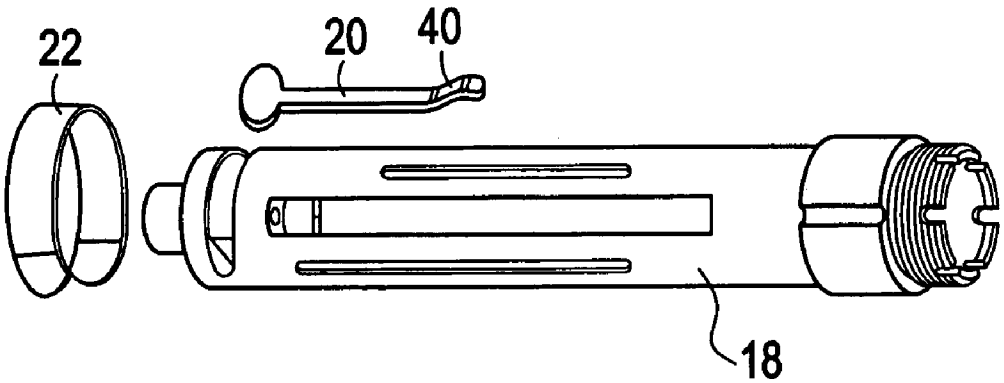
FIG. 3 is a perspective view of the barrel alone.

Referring again to FIG. 3 and more particularly to the piston retainer 20, it should be appreciated that one end of retainer 20 includes a bent section 40 which is bent into a position that will be radially outwardly disposed of the retainer 20 when assembled with barrel 18. The purpose of the bent section 40 is to allow the urging of retainer 20 against retaining ring 16 by a projection 42 within the barrel guide 24. The projection 42 is visible in both FIG. 1 and 2 and is illustrated in an exploded position in FIG. 4.

Because the retainer 20 retains piston 12 merely by pressing against the retainer ring 16 in a radially inward manner but in a relatively longitudinal position, piston 12 is easily forced passed retainer 20 by the force of the exploding charge when the setting tool is discharged. Therefore the piston acts as is intended to forcefully drive a fastening element into a work piece while still being retainable in the position that it is intended to be in, prior to ignition to the powder charge. Retainer 20 provides an extremely reliable and simple means by which the piston can be maintained in the desired position without adding any significant cost or complexity to the setting tool.

It will be appreciated that the use of first and second or other similar nomenclature for denoting similar items is not intended to specify or imply any particular order unless otherwise stated.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method for retaining a piston of a powder actuated setting tool in position comprising:

urging the piston in an axial direction towards contact with a cantilevered retainer disposed within a barrel of the setting tool;

contacting the retainer with a radially upstanding retaining portion of the piston, the piston exerting a substantially radially outward force on the retainer; and retaining the piston with a substantially radially inwardly directed force exerted by the retainer on only an outermost radius of the upstanding retaining portion of the piston.

2. The method as claimed in claim 1 wherein said urging is by a projection of the setting tool.

3. A powder actuated setting tool piston retainer arrangement comprising:

a housing and firing mechanism;

a piston in operable communication with the housing and firing mechanism, the piston having a radially upstanding piston retaining portion which is disposed at an outermost radius of a portion of the piston configured for retention;

a barrel within which the piston is slidably disposable; and a cantilevered retainer disposed at the barrel and positioned to contact only an outermost surface of the piston retaining portion, the cantilevered retainer applying a substantially radially inwardly directed force on the retaining portion when in contact therewith resulting in retention of the piston through friction alone.

4. A powder actuated setting tool piston retainer arrangement as claimed in claim 3 wherein the retainer is longitudinally extending relative to the barrel.

5. A powder actuated setting tool piston retainer arrangement as claimed in claim 3 wherein the retainer includes a bent portion.

6. A powder actuated setting tool piston retainer arrangement as claimed in claim 5 wherein the bent portion is engageable with a projector in a barrel guide, which is in operable communication with the barrel.

7. A powder actuated setting tool piston retainer arrangement as claimed in claim 3 wherein a projector in a barrel guide urges a bent portion towards contact with said retaining portion.

8. A powder actuated setting tool piston retainer arrangement as claimed in claim 3 wherein the retainer bears against the retaining portion.

9. A powder actuated setting tool piston retainer arrangement as claimed in claim 3 wherein the retainer when in contact with the retaining portion, is substantially longitudinally positioned relative to an axis of the setting tool.

10. A powder actuated setting tool piston retainer arrangement as claimed in claim 3 wherein the retainer is retained to the barrel with a spring clip.

11. A powder actuated setting tool piston retainer arrangement as claimed in claim 3 wherein the retaining portion is a ring.

* * * * *